United States Patent [19]

Persson

[11] Patent Number: 4,725,823

[45] Date of Patent: Feb. 16, 1988

[54] SYSTEM FOR TRANSPORTING VALUABLE DOCUMENTS

[75] Inventor: Gunnar O. Persson, Huddinge, Sweden

[73] Assignee: SPC Swedish Protection & Consulting AB, Gotgatan, Sweden

[21] Appl. No.: 7,721

[22] Filed: Jan. 28, 1987

[30] Foreign Application Priority Data

Feb. 25, 1986 [SE] Sweden ..... 8600845

[51] Int. Cl.[4] ..... G08B 13/00

[52] U.S. Cl. ..... 340/571; 340/527; 340/529; 340/574

[58] Field of Search ..... 340/571, 574, 529, 527

[56] References Cited

U.S. PATENT DOCUMENTS 4,573,043 2/1986 Heuker of Hoek et al. ..... 340/571

*Primary Examiner*—Glen R. Swann, III

*Attorney, Agent, or Firm*—Kinzer, Plyer, Dorn, McEachran & Jambor

[57] ABSTRACT

The present invention relates to a system for the vehicular transportation of a lock-equipped cassette (1) for valuable documents between a first station, e.g. a bank or a post office, to a second station. The cassette (1) is intended to be kept in a cassette holder or rack (2) in the first station and the second station, and also in the transporting vehicle. The cassette is provided with an electronic circuit (R1,22) which is characteristic to the cassette concerned and which is arranged to co-act with a controlling activating circuit (M1). When the cassette (1) is lifted from its cassette holder or rack a clock circuit located in the cassette is activated and, unless the cassette is replaced in a cassette holder within a predetermined time, causes an alarm to be activated, this alarm being an acoustic alarm, a device for generating smoke within the cassette, releasing a dye onto the valuable documents contained in the cassette, etc.

5 Claims, 3 Drawing Figures

SYSTEM FOR TRANSPORTING VALUABLE DOCUMENTS

BACKGROUND AND SUMMARY OF THE INVENTION

The present invention relates to a system for the vehicular transport of a cassette containing valuable documents between a first station and a second station.

Such transportation of valuable documents takes place daily between the head office of a bank and one or more branch offices thereof. Strenuous efforts have been made in the past to reduce the risks entailed when transporting valuable documents this way, one of these risks being known as the "sidewalk factor", which has proven difficult to resolve. By "sidewalk factor" is meant the time taken to move a bag or cassette from a bank vault to a transport vehicle, the term cassette being that used in the following to describe valuable document containers. The risk of robbery is very high during this "sidewalk transfer" period, as is also the risk of the transport vehicle being hijacked. Consequently, it is the prime object of this invention to provide a system, or an arrangement, which in spite of its simplicity will practically eliminate all risk of robbery, while affording a high degree of security against internal manipulations.

The main characteristic features of the invention are set forth in the following claims.

BRIEF DESCRIPTION OF THE DRAWINGS

The invention will now be described in more detail with reference to the accompanying drawings, in which.

DESCRIPTION OF THE PREFERRED EMBODIMENTS

Figure 1:
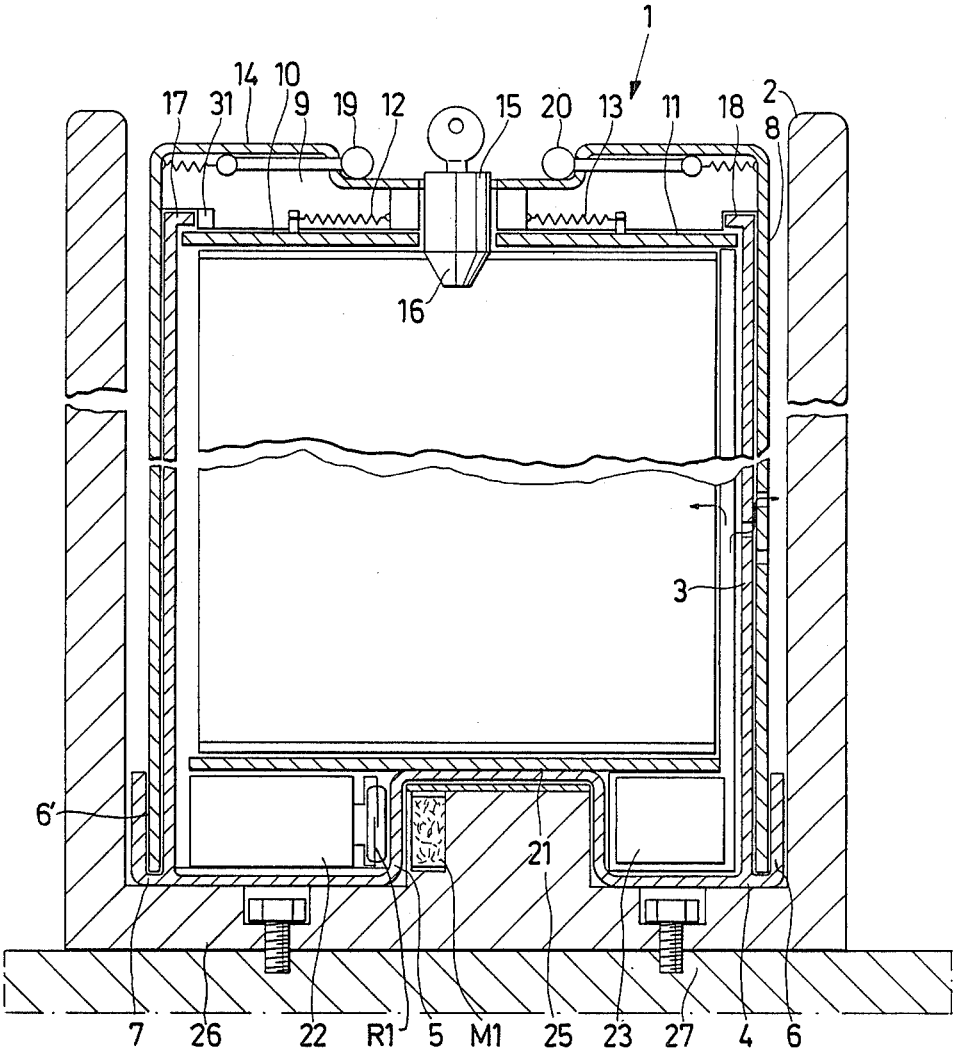
FIG. 1 is a vertical sectional view of a cassette provided with a cassette holder.

FIG. 1 is a vertical sectional view of a cassette 1 and associated cassette holder 2. The cassette 1 comprises an inner case 3, having four walls and a rectangular bottom 4, which in the illustrated embodiment presents a central, box-like recess 5. Welded around the bottom 4 of the cassette is a frame structure 6 which defines together with the vertical side walls of the inner case 3 a channel for accommodating the lower part 7 of an outer protective cover 8, which is fitted over the inner case 3. Two of the mutually opposing walls of the protective cover 8, of which one wall 9 is shown, have provided thereon guides (not shown). Each guide has mounted therein a respective locking bolt 10 and 11 which in their non-locking mode are urged towards one another by springs 12,13. The protective cover 8 has an upper cover member 14 which presents an insertion opening for a lock 15. The lock 15 has a conical lower end 16 which, as the lock 15 is inserted into the opening, cams the two lock bolts 10 and 11 apart, so that the outer end parts of the bolts slide beneath locking flanges 17 and 18 located on the upper edge of the cover 8. The lock is then locked with the aid of a key, so as to be secured to the protective cover 8 by means not shown. Although it is assumed here that the lock 15 can be removed when not in use, the lock can also conceivably be permanently connected to the protective cover 8, and arranged to activate the lock bolts 10,11 in a manner to lock the protective cover 8 securely to the inner case 3 when the key is turned in its locking direction. The cassette is provided with extendable handles 19, 20 which facilitate handling of the cassette when locked. The inner case 3 has a bottom 21 which lies against the box-shaped recess 5 and beneath which there are located two cavities, of which one accommodates an electric circuit 22, described hereinafter with reference to FIG. 2, and the other of which accommodates an alarm device 23. This alarm device may be an acoustic alarm, a chemical generator which generates smoke and/or a dyestuff, or a combination of such well known devices, said device being activated by the electric circuit 22. Connected to the circuit 22 is at least one reed relay R1 which is located in the same cavity as the circuit 22 and is connected thereto. Preferably, however, a plurality of reed relays are used, with their respective contacts combined to form a code, as described hereinafter. Each reed relay is arranged to co-act with an individual permanent magnet. Thus, the reed relay R1 co-acts with the permanent magnet M1, which is mounted in a body 25 of substantially the same shape as the box-like recess 5 and forms a part of the bottom 26 of the cassette holder 2. The cassette holder bottom 26 is firmly secured, by means of bolts or equivalent fastener means, to a foundation surface 27, e.g. the floor of a transport vehicle or some suitable location at the receiving or dispatching station. It is essential that the body 25 is made of a material which is inert to the magnetic field, e.g. wood, plastics or aluminium. On the other hand, at least that part of the inner case wall which covers the reed relay R1 must be made of a material that is permeable to the magnetic field, so that both contacts of the relay can be manipulated by the permanent magnet M1 allotted to the relay.

Figure 2:
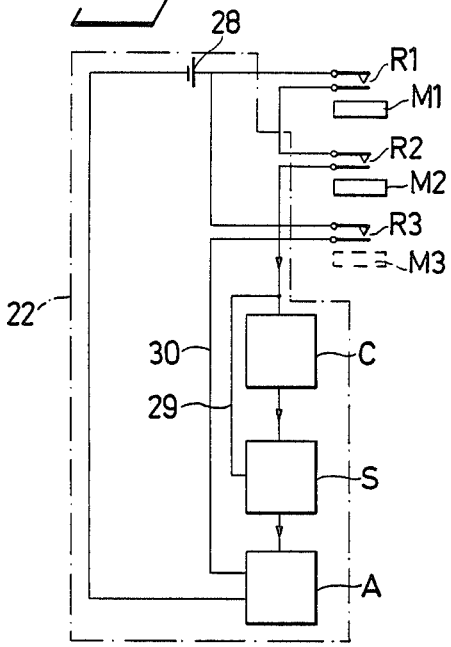
FIG. 2 illustrates an embodiment of an electric circuit forming part of the arrangement.

The electric circuit 22 and the alarm function of the system will now be described with reference to FIG. 2. The circuit is illustrated in the state taken thereby when the cassette is located in the cassette holder, or rack, intended therefor. In FIG. 2 it is assumed that each cassette is provided with three sequentially arranged reed relays R1, R2 and R3, of which R1 and R2, but not R3, shall be activated; i.e. have open contacts when the cassette is located in its cassette holder. The contacts of the reed relay R3 are broken in the non-activated state of the relay, as illustrated. Thus, in the illustrated embodiment the cassette holder, or rack, used has two permanent magnets M1 and M2 which, when the cassette is placed in the rack or holder are intended to lie opposite a respective associated reed relay R1 and R2.

The voltage supplied to the circuit 22 is taken from a battery 28 embodied in the circuit. In the illustrated embodiment the two reed relays R1 and R2 are connected together in series and to a clock circuit C of well known kind, which starts when a voltage is applied to the input thereof and, subsequent to a given time delay, sends a pulse to a switch S, preferably an electronic switch, which closes upon receipt of a pulse and applies a voltage to an alarm circuit A, via a conductor 29, thereby to activate the alarm. The alarm is activated when the cassette is lifted from the cassette holder, or rack, and held outside the cassette for an excessively long period of time, i.e. a period longer than the pre-set time of the clock circuit C, and also when an attempt is made to interfere with or wrongly manipulate the system.

The contacts of relays R1 and R2 close when the locked cassette is removed from the holder, since the contacts are then no longer influenced by their associated magnets.

When the contacts close, the battery is automatically connected to the input of the clock circuit C and the circuit begins to count. If the cassette is not inserted into its intended cassette holder before the aforesaid given time interval has lapsed, the alarm will be activated. If removal of the cassette from a cassette holder, e.g. located in a transport vehicle, within the aforesaid time interval is followed by placing the cassette in an intended cassette rack in, for example, a bank, the two contacts of the two reed relays will open and interrupt the drive voltage to the clock circuit, thereby returning the circuit to zero.

If an attempt is made to activate the relay contacts with the aid of loose magnets, for example in the case of a robbery, the possibility of activating the relays incorporated in the code in the correct manner is minimal, and decreases with an increasing number of relays. For example, if an attempt is made to activate the relays with loose magnets, it is highly possible that one relay forming part of the code will be activated. One such relay is referenced R3 in FIG. 2. If the relay is activated by a magnetic field from the magnet M3 shown in broken lines, the contacts of the relay will close, thus connecting the battery 28 directly to the alarm circuit A, over the conductor 30, and activating the alarm system, i.e. generating an acoustic signal, impregnating the bank-notes or other valuable documents in the cassette with a dye, etc.

Although it is assumed in the aforegoing that reed relays and associated magnets are used, it will be understood that there can be used other electronic switches connected to contacts which are provided in the bottom of the cassettes or on the sides thereof and which co-act with switch-controlling contacts on the cassette rack. In this case, a selected number of connecting contacts lie on voltage and activate the switches in accordance with a selected code.

In the aforegoing it has been assumed that the bag or cassette 1 cannot be opened during the short period of time taken to transfer the cassette from the one fixed cassette holder to a transport vehicle parked outside the dispatching station. It has also been assumed that the cassette is quite secure during transportation. It is quite possible, however, that persons wishing to steal the contents of the cassette or bag can take possession of the keys to the cassette lock, the unlocking codes or magnetic card and consequently open the cassette and remove the contents before the alarm is released, thereby securing the valuable documents before they can be destroyed or drenched in dye, depending on the destruction device incorporated in the system. It is also conceivable for the transport vehicle to be hijacked and then driven to a secluded space and an attempt made to open the cassette, wherewith it is highly probable that the cassette is lifted from the vehicle cassette holder.

Figure 3:
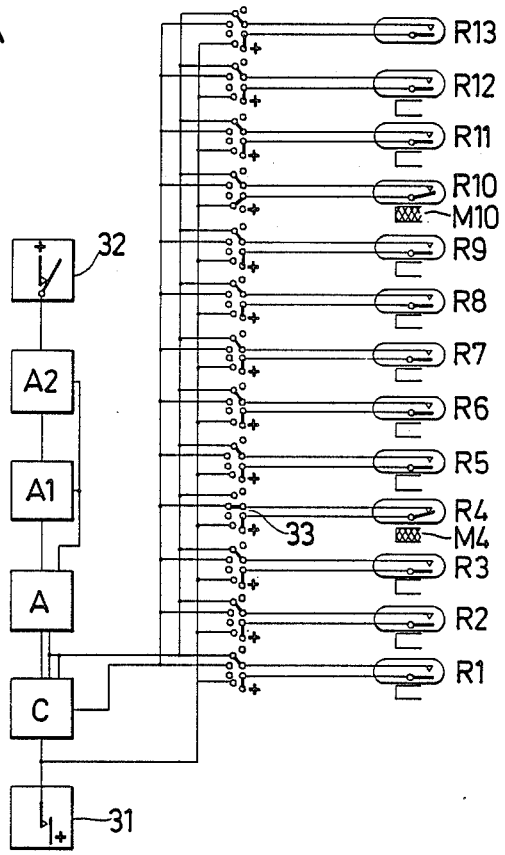
FIG. 3 illustrates a modified electric circuit.

An electric circuit which takes these possibilities and eventualities into account is illustrated in FIG. 3, circuits such as this being those preferred.

In FIG. 3 the reference 32 identifies a main switch for supplying voltage to the circuit, and reference 31 identifies a switch which is intended to be maintained in an open position when the cover member is in position on the cassette and in a closed position when the cover member is removed or the lock 15 opened. In the FIG. 1 embodiment the switch 31 is activated by the locking bolt 10, although it will be understood that the switch may be activated by other means. The switch 32 can be reached by, for example, dismantling the bottom 21 and, while the cassette 1 is in use, is in its closed position, as illustrated in FIG. 3, this Figure illustrating the state of the circuit when a cassette is located in a cassette holder in the transport vehicle.

In the illustrated embodiment each cassette incorporates thirteen reed relays R1–R13, or identification elements comparable therewith, of which only one relay or element is used at a time for identifying or coding the bag or cassette 1. In the illustrated embodiment, the reed relay R4 is connected via a selector contact on a manually settable selector 33 having six selector positions. These selectors 33, one for each reed relay, are mounted beneath the bottom 21 and are set to the code desired. Thus, in the illustrated embodiment, the selector arm of the selector 33 for the reed relay R4 is positioned so that control voltage is applied on the clock circuit C when the cassette 1 is inserted into its cassette holder 2, i.e. either the cassette holder in the dispatching station, the station holder in the transport vehicle, or the cassette holder in the receiving station. All other selectors 33, with the exception of the selector for the reed relay R10, are set to apply voltage directly to the alarm circuit A in the event of corresponding relay contacts being closed. Thus, in contradistinction to the case with the circuit illustrated in FIG. 2, the clock circuit C is inactive when a control voltage is applied and starts in the absence of such voltage, i.e. when the code relay R4 has open contacts.

As indicated in FIG. 3, when the alarm circuit A is activated, an alarm signal is sent to a smoke generating or dye spraying device A1 and to an acoustic alarm device A2.

The cassette 2 in the dispatching station and the receiving station respectively is thus provided with a permanent magnet M4 which holds the reed relay R4 of the cassette closed, so that a control signal is applied to the clock circuit C and holds this circuit in an inactive state.

The vehicle cassette holder 2 to which the cassette 1 is transferred from the dispatching station contains a code magnet M10 which holds the contacts of corresponding reed relays R10 closed during transportation. As will be seen from FIG. 3, corresponding selectors 33 are so set that if an attempt is made to open the cassette cover, the contact 31 being closed, a control voltage will be applied, via the contact 31, the contact of the relay R10, and the associated selector 33, direct to the alarm circuit A, which is subsequently activated and activates the devices A1 and A2. Consequently, it is totally impossible to open the vehicle cassette with the cassette seated in the cassette holder with the aid of a forged key. When the cassette is lifted from the vehicle cassette holder at the receiving station, the contacts of the relay R10 are opened, together with the contacts of the relay R4, thereby interrupting the control voltage to the clock circuit C, which consequently begins to count. The cassette holder of the receiving station is programmed in the same manner as the cassette, i.e. has a magnet in the position M4, and consequently immediately the cassette is placed in the receiving cassette holder the closed relay contact sends a control signal to the input of the clock circuit C, via the selector 33, and the clock circuit is returned to the zero counting position. The contact 31 is closed immediately the cassette is opened, although no control voltage will be applied to the alarm circuit A, since the circuit is no longer influenced by the "vehicle magnet" M10.

If an attempt is made to "pacify" the electronic circuit by lifting the cassette 1 from the cassette holder 2 and inserting one or more magnets, such magnet or magnets must be positioned correctly from the very first. Thus, in order to pacify a cassette having the circuit illustrated in FIG. 3 with a loose magnet it is necessary to first attempt to find the position R4 and close the reed relay contacts and stop the clock circuit C. If, for example, a magnet is applied in position R1, the contact of the relay R1 will close and cause the alarm to be released, since the selector 33 of this relay is set for direct transmission of control voltage to the alarm circuit A. It will readily be understood that the reed relays can be permutated in the manner described with reference to FIG. 2, so as to increase the number of combinations possible with a given number of relays.

When the cassette is used to carry valuable documents contained in a separate storage box, latching devices may be arranged which securely lock the box in the cassette in the event of an alarm, therewith ensuring that bank-notes or other valuable documents enclosed in the box are destroyed, e.g. by dye impregnation, before there is time to remove the box from the cassette.

The aforedescribed embodiments shall be considered solely as examples of the invention, since modifications can be made within the scope of the following claims

I claim:

1. A system for transporting a cassette (1) equipped with a lock and containing valuable documents between a first station and a second station by vehicle, characterized in that the cassette (1) is provided with an electronic circuit which is characteristic to the particular cassette in question; in that the first station, the second station and the transporting vehicle are each provided with a cassette holder or rack (2) which incorporates activating means (M1-M13) which control the electronic circuit (22) and an alarm circuit (A) incorporated in the cassette, the arrangement being such that said alarm circuit is activated when the activating means fail to activate the electronic circuit within a given time interval which exceeds a time interval determined by a timing device (C) incorporated in the electronic circuit, said timing device (C) being arranged to start a count when the cassette (1) is removed from its holder and to produce a control signal for activation of the alarm circuit (A) upon termination of said time interval.

2. A system according to claim 1, characterized in that in addition to the aforesaid activating means the cassette holder or rack (2) in said vehicle also incorporates an activating device (M10) which is characteristic to the vehicle concerned and which co-acts with an electronic identification circuit (R10) in the cassette (1) and with a switch means (31) controlled by the cassette lock (15,16,10,11), the arrangement being such that in the event of the cassette's (1) being unlocked in the vehicle said switch (31) is activated to close an electric circuit, via the electronic identification circuit (R10), to produce said control signal for activation of the alarm circuit (A).

3. A system according to claim 2, characterized in that the electronic circuit of the cassette (1) incorporates a plurality of magnetically actuatable reed relays (R1–R13) which individually (R4) or in a number of mutual combinations (R1, R2) form said electronic circuit characteristic to the cassette concerned or said electronic identification circuit (R10); and in that the cassette holder (2) is provided with permanent magnets (M1–M13) in positions corresponding to the characteristic electronic circuit or circuits, or the reed relays incorporated in the electronic identification circuit.

4. A system according to claim 1, characterized in that the electronic circuit of the cassette (1) incorporates a plurality of magnetically actuable reed relays (R1–R13) which individually (R4) or in a number of mutual combinations (R1,R2) form said electronic circuit characteristic to the cassette concerned or said electronic identification circuit (R10); and in that the cassette holder (2) is provided with permanent magnets (M1–M13) in positions corresponding to the characteristic electronic circuit or circuits, or the reed relays incorporated in the electronic identification circuit.

5. A system according to claim 4, characterized in that those reed relays included in the aforesaid plurality of reed relays but not forming part of the characteristic electronic circuit or the electronic identification circuit are arranged, when influenced by means of a magnet, to close an electric circuit so as to produce said control signal for activating the alarm circuit (A).

* * * * *